US007079801B2

(12) United States Patent
Nakayama

(10) Patent No.: US 7,079,801 B2
(45) Date of Patent: Jul. 18, 2006

(54) IMAGE HEATING APPARATUS WITH COIL INSIDE HEAT GENERATING ELEMENT

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/178,441

(22) Filed: Jul. 12, 2005

(65) Prior Publication Data

US 2005/0244199 A1 Nov. 3, 2005

Related U.S. Application Data

(62) Division of application No. 10/266,760, filed on Oct. 9, 2002, now Pat. No. 6,978,110.

(30) Foreign Application Priority Data

Oct. 9, 2001 (JP) ..... 2001-311551
Oct. 7, 2002 (JP) ..... 2002-293842

(51) Int. Cl.
*G03G 15/20* (2006.01)

(52) U.S. Cl. ..... 399/330; 219/216; 219/619

(58) Field of Classification Search ..... None
See application file for complete search history.

(56) References Cited

U.S. PATENT DOCUMENTS

| | | | | |
|---|---|---|---|---|
| 5,403,995 | A | 4/1995 | Kishino et al. | 219/216 |
| 5,530,556 | A | 6/1996 | Miura et al. | 358/300 |
| 5,862,445 | A | 1/1999 | Ogawa et al. | 399/329 |
| 6,026,273 | A | 2/2000 | Kinouchi et al. | 399/328 |
| 6,377,775 | B1 | 4/2002 | Nakayama et al. | 399/328 |
| 6,456,818 | B1 | 9/2002 | Nakayama et al. | 399/328 |
| 6,580,895 | B1 | 6/2003 | Hirst et al. | 399/330 |
| 6,643,491 | B1 | 11/2003 | Kinouchi et al. | 399/330 |

FOREIGN PATENT DOCUMENTS

| | | |
|---|---|---|
| DE | 3244392 A1 | 6/1984 |
| EP | 490664 A1 | 6/1992 |
| JP | 59-62866 | 4/1984 |
| JP | 9-197869 | 7/1997 |
| JP | 10-153922 | 9/1998 |
| JP | 2000-275996 | 10/2000 |
| JP | 2000-285996 | 10/2000 |
| JP | 2001-066921 | 3/2001 |

*Primary Examiner*—Robert Beatty
(74) *Attorney, Agent, or Firm*—Fitzpatrick, Cella, Harper & Scinto

(57) ABSTRACT

A fixing device includes a coil for generating a magnetic field; a heating medium having an electroconductive layer which is provided at its inside with said coil, wherein eddy currents are generated by a magnetic field generated by current through said coil so that heat is generated in said electroconductive layer, and an unfixed toner image is fixed on a recording material by the heat, and said heating medium has an inner side spaced from said coil and having a dark color.

2 Claims, 3 Drawing Sheets

IMAGE HEATING APPARATUS WITH COIL INSIDE HEAT GENERATING ELEMENT

This application is a divisional of U.S. patent application Ser. No. 10/266,760, filed on Oct. 9, 2002, now U.S. Pat. No. 6,978,110.

FIELD OF THE INVENTION AND RELATED ART

The present invention relates to a heating apparatus using induction heating as a heat generation source, a heat-fixing device for heating and fixing on a recording material a toner image formed on an upper such as a recording paper or a transfer sheet using the heating apparatus, an electrophotographic apparatus, an electrostatic recording apparatus, a printer and a facsimile using the heat-fixing device.

An image forming apparatus such as an electrophotographic apparatus, an electrostatic recording apparatus, a printer or a facsimile is provided with a heat-fixing device for heating and fixing on the recording material a toner image transferred thereonto or a toner image directly formed on t recording material. The heat-fixing device comprises, for example, a fixing roller (heating roller) for fusing the toner on the recording material and a pressing roller cooperating with the fixing roller to press the recording material therebetween. The fixing roller is hollow and supports a heat generating element by a holding means on the center shaft of the fixing roller. The heat generating element, for example, is in the form of a tube-like heat generation heater such as a halogen lamp, and generates heat by being supplied with a predetermined voltage. The halogen lamp is disposed at the center of the fixing roller, and therefore, the heat generated by the halogen lamp is radiated uniformly to the inner wall of the fixing roller, so that temperature distribution of the outer wall of the fixing roller is uniform with respect to the circumferential direction.

The outer wall of the fixing roller is heated until the temperature thereof becomes proper to fix the image (for example, 150200° C.). With this state, the fixing roller and the pressing roller are rotated in the opposite rotational directions while being in press-contact to each other, and nip the recording material carrying the toner therebetween. In t press-contact portion (nip) between the fixing roller and the pressing roller, the toner on the recording material is fused by the heat of the fixing roller, and is fixed on the recording material by the pressure imparted by the rollers.

However, in the heat-fixing device using the heat generating element in the form of a halogen lamp, since the fixing roller is heated using the radiation heat from the halogen lamp, the time required for the temperature of the fixing roller to reach the predetermined temperature suitable for the image fixing after the main switch is actuated (warming-up time), is relatively long. During the relatively long time, the user is unable to use the copying machine and has to wait.

On the other hand, if a larger amount of the electric power is applied to the fixing roller in an attempt to improve the operationality by reduction of the warming-up time, the electric energy consumption of the heat-fixing device increases, against the energy saving demand. Accordingly, it is important to improve both of the operationality and the energy saving.

Japanese Laid-open Patent Application Sho 59 33787 has proposed, to meet both of such demands, a heating apparatus of an induction heating type using high frequency induction as addition heat source. The heating apparatus comprises a hollow fixing roller of metal electroconductor, and a coil concentrically disposed therein, wherein a high frequency current is applied through the coil by which induction eddy currents is generated in the fixing roller by the resultant high frequency magnetic field, so that joule heat generation occurs in the fixing roller per se due to the skin resistance. With such a heating apparatus of the induction heating type, the conversion efficiency of the electro-thermal conversion is very high, and therefore, the warming-up time can be reduced.

However, the heating apparatus of the induction heating type involves a problem of the temperature rise due to joule heat generation of the coil per se because a large current such as several Ampere to several tens Ampere flows through the coil. When the induction coil is disposed in the inner space of the heating member, the temperature of the induction coil is influenced by the temperature of the heating medium, and in addition, it is influenced by the heat generation of the coil per se, with the result that temperature is higher than that of the heating medium. Particularly when the coil, coil unit or the like is not contacted to the heating medium, the heat of the coil does not escape to any place, and therefore, the temperature rise of the coil is significant.

As a countermeasure for preventing a temperature rise of the induction coil, Japanese Laid-open Patent Application Hei 09 197869 discloses an emissivity of radiation at the inner surface of the heating medium is lowered, so that influence of the heating medium to the induction coil is reduced. With this method, it is possible to reduce the influence of the heating medium, but the temperature rise of the induction coil per se due to the induction coil per se remains. When the temperature of the induction coil or the temperature of the coil holder supporting the induction coil becomes higher than the temperature in the inner space between the heating medium and the coil holder, the heat of the induction coil is radiated into the inner space as radiant heat. However, since the emissivity of the inner surface of the heating medium is low, the radiated heat is not easily absorbed by the heating medium, and therefore, the radiant heat is not utilized effectively. On the other hand, a current flows through the induction coil to maintain the temperature of the heating medium, and therefore, the energy deterioration is large correspondingly.

The heat transfer under a temperature gradient such that heat conduction is dominant when solid members are contacted to each other, and radiant heat is dominant as compared with the heat conduction when there is an air layer therebetween.

A structure with which the radiated heat from the induction coil is effectively used.

SUMMARY OF THE INVENTION

Accordingly, it is a principal object of the present invention to provide a fixing device or an image forming apparatus wherein heat of an induction coil radiated into a space in a heating medium.

It is another object of the present invention to provide a fixing device or an image forming apparatus wherein transfer of heat to the heating medium is increased by promoting radiation of the heat from an induction coil, so that electric power saving is accomplished.

According to an aspect of the present invention, there is provided a A fixing device comprising a coil for generating a magnetic field; a heating medium having an electroconductive layer which is provided at its inside with said coil, wherein eddy currents are generated by a magnetic field generated by current through said coil so that heat is generated in said electroconductive layer, and an unfixed toner image is fixed on a recording material by the heat, and said heating medium has an inner side spaced from said coil and having a dark color.

According to another aspect of the present invention, there is provided a fixing device comprising a coil for generating a magnetic field; a heating medium having an electroconductive layer which is provided at its inside with said coil, wherein eddy currents are generated by a magnetic field generated by current through said coil so that heat is generated in said electroconductive layer, and an unfixed toner image is fixed on a recording material by the heat, a non-magnetic member disposed between said coil and said heating medium with a gap from said heating medium, wherein said non-magnetic member is closely contacted with said coil, and an inner surface of said heating medium has a dark color.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

The description will be made as to the preferred embodiments of the present invention in contact with the accompanying drawings.

Embodiment 1

(1) Example of Image Forming Apparatus

Figure 1:
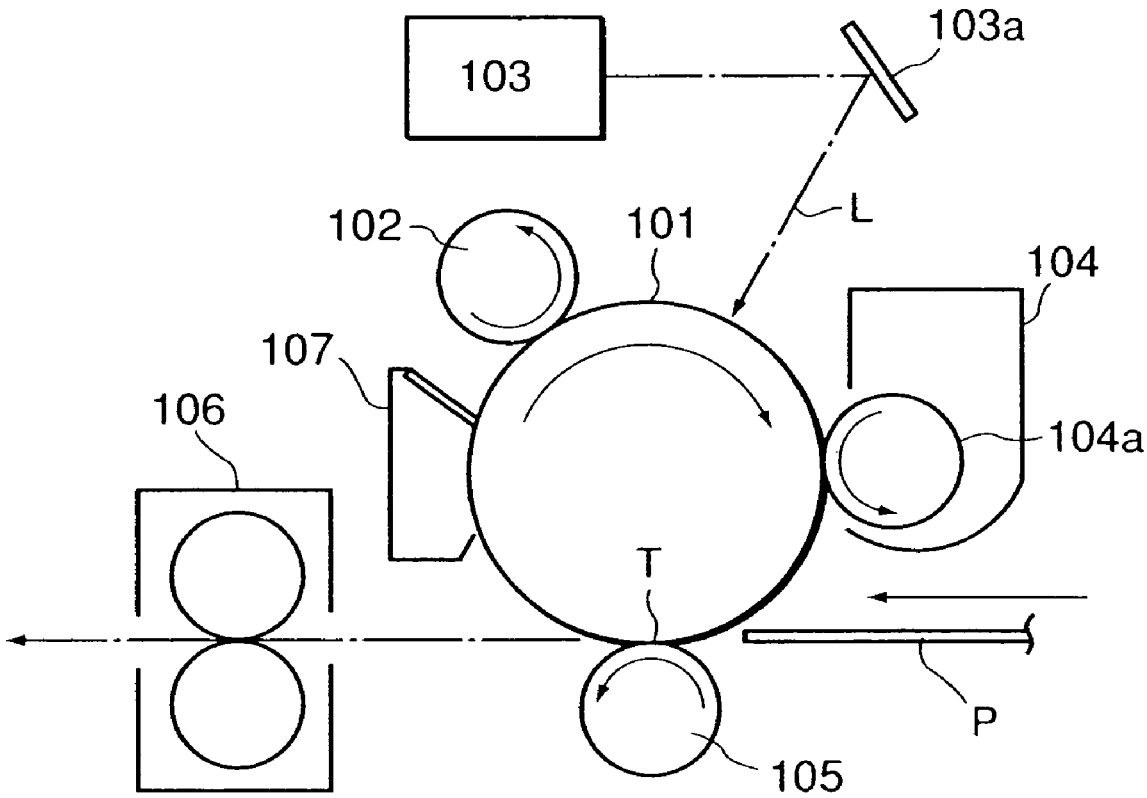
FIG. 1 is a schematic illustration of an image forming apparatus employing a heat-fixing device according to the present invention.

FIG. 1 is a schematic general arrangement of an image forming apparatus employing a heat-fixing device according to an embodiment of the present invention, and the image forming apparatus is an electrophotographic laser beam printer of an image transfer type. FIG. 1, designated by 101 is an electrophotographic photosensitive drum as an image bearing member, which is rotated in a clockwise direction indicated by an arrow at a predetermined peripheral speed.

Designated by 102 is an electroconductive elastic charging roller (charging means) which is contacted to the photosensitive drum 101 at a predetermined pressure, and is rotated by the rotation of the photosensitive drum 101, or it is rotated independently of the photosensitive drum 101. The charging roller 102 is supplied with a predetermined charging bias voltage from an unshown voltage source portion, so that peripheral surface of the rotating photosensitive drum 101 is electrically uniformly charged to a predetermined polarity and potential.

Designated by 103 is an exposure device (information writing means). The exposure device 103 is a laser scanner in this embodiment, and emits a laser beam modulated in accordance with time-series electrical digital pixel signal indicative of image information to be written. The laser beam is projected onto a surface of the rotating photosensitive drum 101 having been uniformly charged by way of folding mirror 103*a*. By this, an electrostatic latent image is formed on the surface of the photosensitive drum 101 corresponding to the scanning exposure pattern.

Designated by 104 is a developing device which develops the electrostatic latent image formed on the surface of the photosensitive drum 101 into a toner image. Designated by 104*a* is a developing roller which is supplied with a predetermined developing bias voltage from an unshown voltage source portion.

Designated by 105 is an electroconductive elastic transfer roller (transferring means), which is press-contacted to the photosensitive drum 101 at a predetermined pressure to form a transfer nip T. Into the transfer nip T, a recording material such as an OHP film, recording paper, (transfer sheet) P is fed at a predetermined controlled timing from an unshown feeding portion, and is nipped between the transfer roller and the photosensitive member, by which the toner image is sequentially transferred from t photosensitive drum 101 onto the surface of the recording paper P. The transfer roller 105 is supplied with a proper bias voltage having a polarity opposite the charging polarity of the toner from an unshown voltage source portion at a predetermined controlled timing.

Designated by 106 is a heat-fixing device for heating and fixing an unfixed toner image. The recording paper P having passed through the transfer nip T is sequentially separated from the surface of the photosensitive drum 101, and is introduced into the heat-fixing device 106. The toner image if heated and pressed on the recording paper P so that it is fixed on the recording paper P. The recording paper P having passed through the heat-fixing device 106 is sheet discharged as a print (or copy). The heat-fixing device 106 has an induction heating type heat source, which will be described in detail hereinafter.

Designated by 107 is a cleaning device for the surface of the photosensitive drum and functions to remove contaminants remaining on the surface of the photosensitive drum 101 such as untransferred toner, paper dust or the like. The surface of the photosensitive drum cleaned by the cleaning device 107 is repeatedly used for the image formation. (2) heat-fixing device 106

Figure 2:
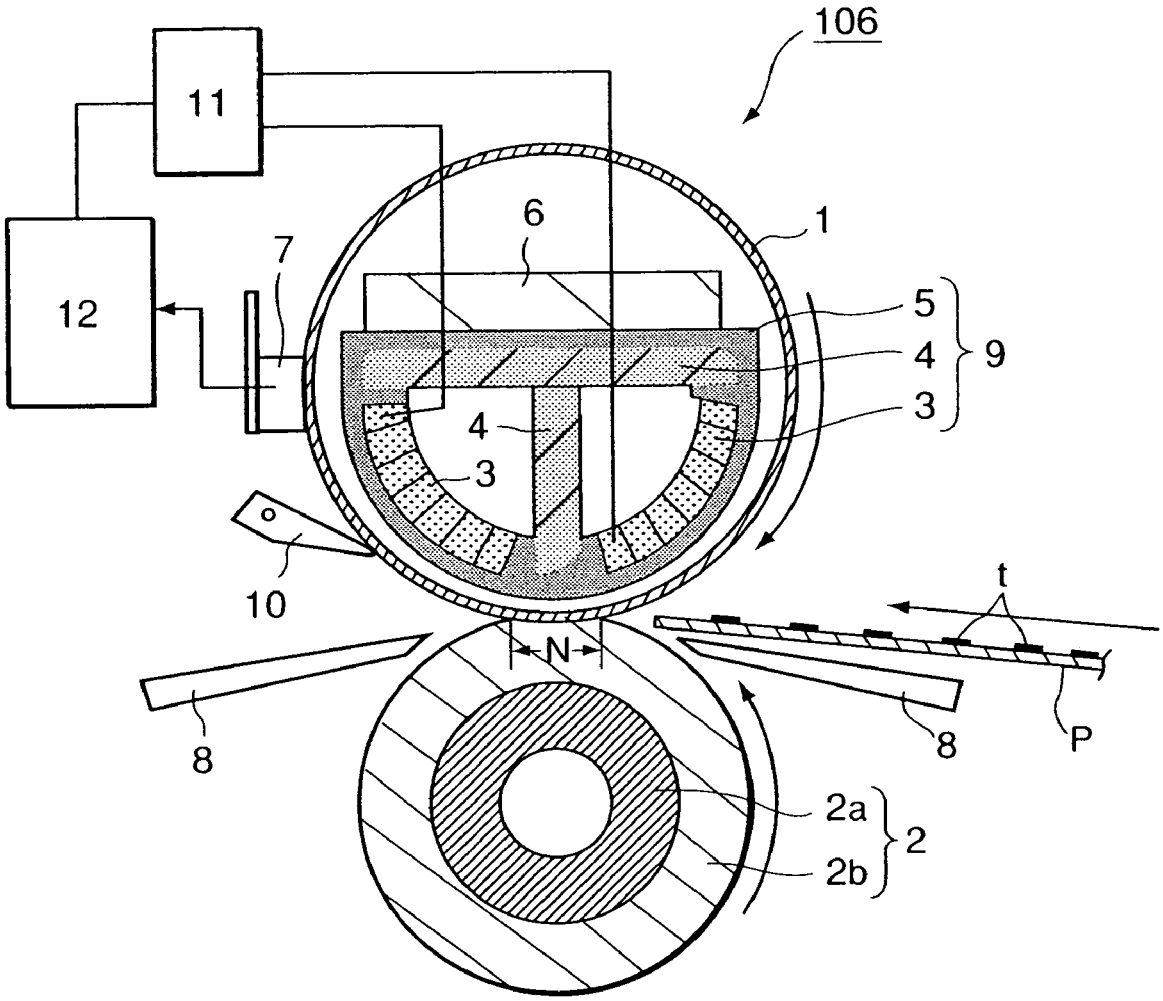
FIG. 2 is a cross-sectional view of a heat-fixing device using a heating apparatus as a heat source according to an embodiment of the present invention.

FIG. 2 is a schematic cross-sectional view of a heat-fixing device 106 used as a heat source (heating apparatus). The heat-fixing device 106 comprising a fixing roller 1 as a heating member which is heated by induction heating, and a pressing roller 2 as a pressing member, between which a nip N is formed. Through the nip N, a recording paper P (recording material) carrying the unfixed toner image t is introduced and is fed while the head and nip pressure are imparted, by which the unfixed toner image t is heat-fixed on the surface of the recording paper P (heat roller type).

The fixing roller 1 is a core metal cylinder of magnetic metal member (iron) having an outer diameter of 40 mm and a thickness of 0.7 mm, and the surface thereof may be provided with an outer surface layer of 10 50 μm of fluorine resin material such as PTFE, PFA or the like.

The fixing roller 1 is rotatably supported by a fixing unit frame at its opposite ends, and is rotated in the clockwise direction (arrow) at a predetermined peripheral speed by an unshown driving system.

The pressing roller 2 comprises a hollow core metal 2*a* and elastic layer 2*b* of a heat resistive rubber layer having a surface of parting property and formed on an outer surface. The pressing roller 2 is extended in parallel with the fixing roller 1 below the fixing roller 1, and the hollow core metal 2*a* thereof is rotatably supported on the unshown fixing unit frame at the opposite ends. It is urged to the rotational axis of the fixing roller 1 by an unshown urging mechanism using a spring or the like to press it against the lower surface of the fixing roller 1 at a predetermined pressure.

By the press-contact between the fixing roller 1 and the pressing roller 2, the elastic layer 2*b* deforms elastically at the press-contact portion to form a fixing nip N having a predetermined width (heating portion for the member to be heated). In this embodiment, the pressing roller 2 is loaded with a total pressure of approx. 304N (approx. 30 kgf), with which the nip width of the fixing nip N is approx. 6 mm. The pressing roller 2 is rotated by the fixing roller 1 through the press-contact frictional force at the fixing nip N. The total pressure and the nip width are only examples, and may be different.

Designated by 9 is an induction coil assembly (magnetic flux generating means) which comprises an induction coil 3, a magnetic core 4, a coil holder 5 and the like. The induction coil 3 is coated with a coating member of a heat resistive material such as polyimide, polyamide-imide or the like. The coil holder 5 is a trough shape member having a semi-circular cross-section of a heat resistive resin material such as PPS, PEEK, phenolic resin or the like. It houses an induction coil 3 wound into a boat-shape inside the coil holder 5 and a magnetic core 4 which is a combination of flat ferrite plates into a T-shape. The coil holder 5, the induction coil 3 and the magnetic core 4 constitute an induction coil assembly 9. The outer surface of the coil holder 5 is disposed opposed to an inner surface of the fixing roller 1. The induction coil 3 is closely contacted to the coil holder 9.

The induction coil assembly 9 is held on a stay 6 and is inserted into the hollow portion of the fixing roller 1 with the semi-circular arcuation of the coil holder 5 faced down. The opposite ends of the stay 6 are fixed on an unshown fixing unit frame. The induction coil assembly 9 is disposed such that gap is provided between the induction coil assembly 9 and the fixing roller 1. The description will be made as to the heating operation.

The fixing roller 1 is rotated, and the pressing roller 2 is rotated by the fixing roller 1, and an AC current of 10 100 kHz is applied to the induction coil 3 from an excitation circuit 11. The magnetic field induced by the AC current produced eddy currents in the inner surface of the fixing roller 1 which is an electroconductive layer, thus generating Joule heat. That is, the fixing roller 1 is induction-heated.

The temperature of the fixing roller 1 is detected by a temperature sensor 7 a thermister or the like disposed contacted to the surface of the fixing roller, and the detected temperature information (detection signal) is inputted to the control circuit 12. The control circuit 12 increases and decreases the electric power supply to the induction coil 3 from the excitation circuit 11 in response to the detected temperature information such that surface temperature of the fixing roller 1 is maintained at a predetermined constant temperature, that is, such that temperature of the fixing nip N is maintained at the predetermined fixing temperature.

The fixing roller 1 and the pressing roller 2 are rotated, and the fixing roller 1 is heated by induction and is controlled at a predetermined temperature. In this state, a recording material P carrying the unfixed toner image t is guided by a feeding guide 8 into the fixing nip N and is nipped and fed therethrough, by which the unfixed toner image t is heated and fixed on the surface of the recording material P by the heat and the nip pressure of the fixing roller 1. The recording material P passed through the fixing nip N is separated from the surface of the fixing roller 1 and fed out. Designated by 10 is a separation claw, disposed contacted to or adjacent the surface of the fixing roller 1 at the recording material outlet side of the fixing nip N, for separating the recording material. In order to increase the heat generation of the fixing roller 1, the number of windings of the induction coil 3, the magnetic core 4 is made of a material having a high magnetic permeability or low remanent flux density, or the frequency of the AC current is raised.

The description will be made as to the occasion in which the temperature of the induction coil 3 exceeds a temperature of the air layer between the coil holder 5 and the fixing roller 1 due to the heat generation of the coil per se or the like. In this embodiment, the induction coil and the coil holder 5 are closely contacted, so that heat conduction first occurs from the coil 3 to the coil holder 5. Since there is a gas layer such as air layer around the coil holder 5, the heat conduction from the coil holder 5 to the gas layer is very small. However, the temperature gradient is such that temperature of the coil holder 5 is higher than the temperature of the inside space, the heat is radiated from the coil holder 5 into the inside space. The transfer of the heat from a solid material to an air layer is larger by the heat radiation than by the heat conduction. In this manner, the heat of the induction coil 3 is conducted to the coil holder 5, and the heat is radiated from the coil holder 5, and therefore, the temperature of the inside space rises with the rising of the temperature of the induction coil 3. This is particularly noted by the inventor, and the radiated heat is used by the fixing roller 1 so that energy is efficiently used. More particularly, the inner surface ot fixing roller is painted black by a blackening treatment. By the blackening treatment, the absorption amount of the heat in the inside space can be increased.

The description will be made as to the fact that heat absorption factor rises by the blackening. The ideal object in relation to absorption and radiation of infrared radiation at a surface is a black body. An object or body exhibiting spectral absorptance of 1 for all wavelengths emits the maximum heat radiation at the temperature, and such an object or body is called "black body".

Emissivity (e) (=all radiation energy of the object/all radiation of the black body having the same temperature) of the black body is 1, and the emissivity of another member is between 1 and 0. It is known that emissivity of heat is generally equal to the absorption factor of heat of the same member.

Therefore, in order to raise the absorption factor of heat, it is required to raise the emissivity of heat. So, it is desirable to approach to the black body from the standpoint of raising the absorption factor of heat.

In this embodiment, in order to raise the absorption factor of heat, the inner surface of the fixing roller 1 is subjected to blackening treatment. In an example of the blackening treatment, the inner surface of the fixing roller 1 is painted with black paint. The blackening treatment preferably provides a heat radiation rate not less than 0.9. The description will be made as to.

For the measurement, AR1000 series measuring device available from Anritsu Keiki Kabushiki Kaisha Japan is used. The device determines the heat radiation rate of an object from a temperature difference between a temperature of the surface of the object measured by contact and a simultaneously measured temperature thereof using a non-contact measurement. The surface temperature is detected through non-contact method in a dark room, since there is an influence of an external disturbance of infrared radiation. Since the accuracy of measurement of the surface temperature increases with increase of the temperature, the temperature is selected to be 100° C. by the contact type measurement. As regards the ambient conditions, in order to minimize the variations, they were room temperature of 23° C. and humidity of 50%. The number of measurements is 10, and an average of the 10 data is determined as the heat radiation rate.

Embodiment 2

T second embodiment is similar to the first embodiment, but is different in that inner surface of the fixing roller 1 is roughened to Rz=1 μm–100 μm by sand-paper or sandblast process and is thereafter is coated with black paint.

In this embodiment, the surface roughness of the fixing roller is increased by the blast process, so that area of the portion absorbing the heat is large, so that absorption factor of the heat is raised. According to this embodiment, the surface area of the inner surface of the fixing roller is increased by the combination of the increase of the surface roughness and the blackening, thus enhancing the heat absorption of the inside space. By doing so, the heat from the temperature rise of the coil is absorbed by the heating medium, so that heat is efficiently utilized, and therefore, the electric power for raising the temperature of the heating medium can be saved.

Embodiment 3

In this embodiment, the inner surface of the fixing roller is blackened, and the emissivity of the surface of the coil holder 4 is raised, by which the amount of the radiant heat into the inside space from the coil holder 4 is increased.

Figure 3:
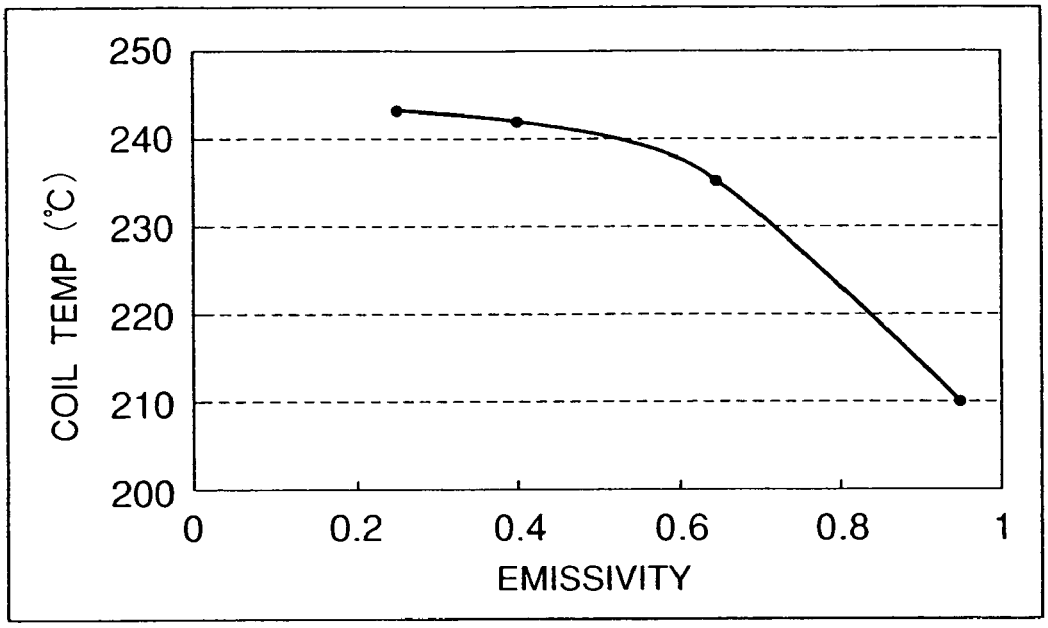
FIG. 3 shows a relation between the emissivity of radiation and the coil temperature.

Referring to FIG. 3, the description will be made as to the emissivity of the coil holder 4 and the coil temperature. In this Figure, the coil temperature is the temperature to which the coil temperature converges when the temperature of the fixing roller is maintained at 200° C. for a predetermined time period with the above-described structure of the fixing device. It will be understood that when the emissivity is not less than 0.65, the inclination of the decrease of the temperature of the induction coil 3 is large. Therefore, it is preferable that emissivity of the coil holder 4 is not less than 0.65. In this case, the heat is radiated into the inside space of the fixing roller by the amount corresponding to the decrease of the temperature.

Figure 4:
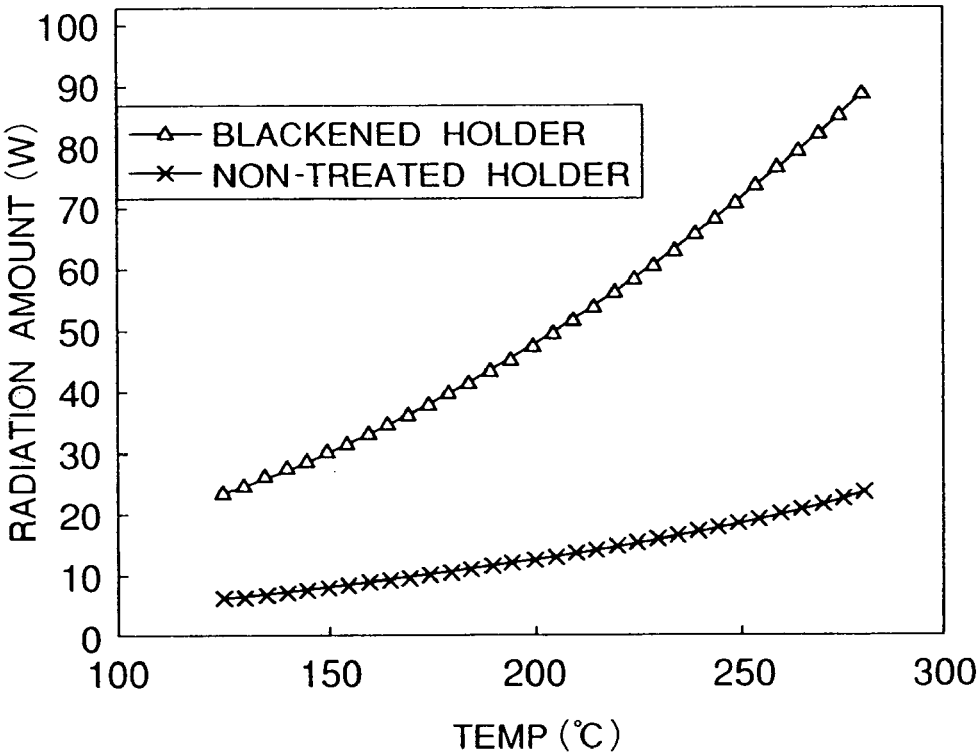
FIG. 4 shows comparison of the radiations relative to a temperature between a coil holder having an untreated surface and a coil holder having a treated surface (black).

The description will be made as to the heat quantity actually radiated from the coil holder 5. FIG. 4 shows a relation between the coil holder surface temperature and the radiation heat quantity with respect to an untreated object and a blackened object. The coil holder 5 has a length of 310 mm, and the section is semicircular with a radius of 15 mm. The emissivity of the untreated object was approx. 0.25, and the emissivity of the blackened object is 0.95.

From FIG. 4, when the temperature of the surface of the coil holder is approx. 200° C. which is the temperature in an actual device, the amount of radiation from the untreated object is approx. 12 W, whereas the amount of radiation from the treated object is approx. 45 W. It is understood that 200° C. to the inner surface of the fixing roller is larger.

This can be supported by following Stefan-Boltzmann law of radiation:

E: total radiation heat quantity (W)

e(T): amount of heat radiation from the black body at an absolute temperature T ($W/m^2$)

S: a surface area of the body from which the heat is radiated ($m^2$)

T: absolute temperature (K)

σ: Stefan-Boltzmann constant ($W/(m^2K4)$)

ϵ: heat emissivity of the material from which the heat is radiated.

Then, the heat radiation amount e(T) is expressed as follows:

$$e(T)=\sigma T4$$

The total radiation energy E from the surface area S having the heat emissivity ϵ is E=ϵSe (T).

The radiant heat quantity increases with the heat radiation rate ϵ.

As will be understood from FIG. 4, the radiation heat quantity raised by approx. 33 W if the emissivity of the coil holder 5 is raised from 0.25 to 0.95. It will be understood that with the increase of the emissivity of the coil holder 5, the absorption of the heat quantity into the inner surface of the fixing roller increases.

In this embodiment, the coil holder 5 is blackened. But, by increasing the surface roughness, the radiant heat from the coil holder 5 can be increased.

While the invention has been described with reference to the structures disclosed herein, it is not confined to the details set forth and this application is intended to cover such modifications or changes as may come within the purpose of the improvements or the scope of the following claims.

What is claimed is:

1. An image heating apparatus comprising:

a coil for generating a magnetic flux; and a heat generating element for generating heat by the magnetic flux generated by said coil to heat an image on a recording material by the heat from said heat generating element, wherein said coil is disposed inside said heat generating element without contact thereto, and wherein an inner surface of said heat generating element is treated for high thermal emissivity treatment so as to have a thermal emissivity of at least 0.9 before starting of use of said apparatus.

2. An apparatus according to claim 1, further comprising a heat receiving member, contacted to said coil, for receiving heat from said coil, said heat receiving member being disposed opposed to said heat generating element without contact thereto, and wherein a surface opposed to said heat generating element has an emissivity of at least 0.65.

* * * * *

UNITED STATES PATENT AND TRADEMARK OFFICE

CERTIFICATE OF CORRECTION

PATENT NO. : 7,079,801 B2
APPLICATION NO. : 11/178441
DATED : July 18, 2006
INVENTOR(S) : Toshinori Nakayama It is certified that error appears in the above-identified patent and that said Letters Patent is hereby corrected as shown below:

COLUMN 1:
Line 23, “t” should read --the--.
Line 40, “150200°C.).” should read --150-200°C.).--.
Line 43, “t” should read --the--.
Line 57, “operationality” should read --operability--.
Line 61, “operationality” should read --operability--.

COLUMN 2:
Line 3, “is” should read --are--.
Line 13, “flows” should read --flow--.
Line 25, “discloses an” should read --discloses that an--.
Line 54, “radiated” should read --radiates--.
Line 63, “A” should be deleted.

COLUMN 4:
Line 25, “t” should read --the--.
Line 46, “formation. (2)” should read --formation. ¶ (2)--.
Line 47, “heat-fixing device” should read --Heat-fixing Device--.
Line 62, “10 50 µm” should read --10-50 µm--.

COLUMN 5:
Line 46, “10 100” should read --10-100--.
Line 49, “produced” should read --produces--.
Line 53, “thermister” should read --thermistor--.

COLUMN 6:
Line 62, “the description will be made as to.” should be deleted.

UNITED STATES PATENT AND TRADEMARK OFFICE

CERTIFICATE OF CORRECTION

PATENT NO. : 7,079,801 B2
APPLICATION NO. : 11/178441
DATED : July 18, 2006
INVENTOR(S) : Toshinori Nakayama It is certified that error appears in the above-identified patent and that said Letters Patent is hereby corrected as shown below:

COLUMN 7:
Line 16, "T" should read --The--.

Signed and Sealed this

Twenty-fourth Day of April, 2007

JON W. DUDAS
*Director of the United States Patent and Trademark Office*